US009605331B2

(12) United States Patent
Nara et al.

(10) Patent No.: US 9,605,331 B2
(45) Date of Patent: Mar. 28, 2017

(54) BATCH ANNEALING FURNACE FOR COILS

(71) Applicant: JFE STEEL CORPORATION, Tokyo (JP)

(72) Inventors: Seiko Nara, Tokyo (JP); Toshio Ishii, Tokyo (JP); Shinji Koseki, Tokyo (JP); Katsuhiro Takebayashi, Tokyo (JP); Naoki Nakata, Tokyo (JP); Hiroyuki Fukuda, Tokyo (JP); Eitaro Shidara, Tokyo (JP); Takashi Wada, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 14/369,143

(22) PCT Filed: Dec. 27, 2012

(86) PCT No.: PCT/JP2012/084297

§ 371 (c)(1),
(2) Date: Jun. 26, 2014

(87) PCT Pub. No.: WO2013/100191

PCT Pub. Date: Jul. 4, 2013

(65) Prior Publication Data

US 2015/0001769 A1 Jan. 1, 2015

(30) Foreign Application Priority Data

Dec. 28, 2011 (JP) ..... 2011-289145

(51) Int. Cl.

| | |
|---|---|
| ***C21D 9/00*** | (2006.01) |
| ***C21D 9/46*** | (2006.01) |
| ***C21D 9/673*** | (2006.01) |
| ***F27B 5/06*** | (2006.01) |
| ***F27B 5/14*** | (2006.01) |
| ***F27B 17/00*** | (2006.01) |
| ***F27B 11/00*** | (2006.01) |
| ***F27B 5/04*** | (2006.01) |

(Continued)

(52) U.S. Cl.
CPC ..... *C21D 9/0062* (2013.01); *C21D 9/0025* (2013.01); *C21D 9/46* (2013.01);
(Continued)

(58) Field of Classification Search
CPC .. C21D 9/0025; C21D 9/0062; C21D 9/0068; C21D 9/46; C21D 9/673;
(Continued)

(56) References Cited

U.S. PATENT DOCUMENTS 3,540,710 A * 11/1970 Kazuo et al. ..... 432/206
3,832,129 A * 8/1974 Derbyshire et al. ..... 432/77
(Continued)

FOREIGN PATENT DOCUMENTS

CN 101250620 8/2008
DE 20113882 1/2002
(Continued)

OTHER PUBLICATIONS

International Search Report, PCT/JP2012/084297, Mar. 5, 2013.
(Continued)

*Primary Examiner* — Scott Kastler
*Assistant Examiner* — Michael Aboagye
(74) *Attorney, Agent, or Firm* — Young & Thompson

(57) ABSTRACT

A batch annealing furnace includes a coil support base on which an end face of a coil is mounted and that supports the coil with an axis of the coil being upright, an inner cover that covers an entire body of the coil mounted on the coil support base, and a cooling pipe that extends downward from the upper part of the inner cover to a cavity of the inner peripheral part of the coil mounted on the coil support base and cools the coil from the inner surface side by passing a coolant through the inside of the cooling pipe.

10 Claims, 15 Drawing Sheets
(2 of 15 Drawing Sheet(s) Filed in Color)

(51) Int. Cl.
*F27D 5/00* (2006.01)
*F27D 9/00* (2006.01)

(52) U.S. Cl.
CPC ..... *C21D 9/673* (2013.01); *F27B 5/04* (2013.01); *F27B 5/06* (2013.01); *F27B 5/14* (2013.01); *F27B 11/00* (2013.01); *F27B 17/0016* (2013.01); *F27D 5/0006* (2013.01); *F27D 9/00* (2013.01); *C21D 9/0068* (2013.01); *F27D 2009/0008* (2013.01); *F27D 2009/0018* (2013.01)

(58) Field of Classification Search
CPC .. C21D 9/663; C21D 1/84; C21D 9/67; F27B 11/00; F27B 17/0016; F27B 5/04; F27B 5/06; F27B 5/14; F27D 2009/0008; F27D 2009/0018; F27D 5/0006; F27D 9/00
USPC ..... 266/259, 249, 263, 262; 437/43, 53, 77, 437/81, 116, 233; 432/43, 53, 77, 81, 432/116, 233, 206, 209, 212
See application file for complete search history.

(56) References Cited

U.S. PATENT DOCUMENTS 4,310,302 A * 1/1982 Thekdi et al. ..... 432/205
4,596,526 A * 6/1986 Soliman ..... 432/23

FOREIGN PATENT DOCUMENTS

| | | |
|---|---|---|
| FR | 975904 | 3/1951 |
| GB | 568980 | 4/1945 |
| JP | 59-035635 | 2/1984 |
| JP | 05-287390 | 11/1993 |
| JP | 05-295453 | 11/1993 |
| JP | 06-006451 | 1/1994 |
| JP | 11-293348 | 10/1999 |
| JP | 2003-328038 | 11/2003 |
| JP | 2005-226104 | 8/2005 |
| JP | 2006-257486 | 9/2006 |
| JP | 2006-274343 | 10/2006 |
| JP | 2008-195998 | 8/2008 |
| JP | 2012-219295 | 11/2012 |
| SU | 1652365 | 5/1991 |

OTHER PUBLICATIONS

Japanese Office Action, dated Feb. 16, 2015, in corresponding Japanese Patent Application No. 201280061687.9.
Korean Office Action, dated Mar. 31, 2015, in corresponding Korean Patent Application No. 10-2014-7017133.
Extended European search report, dated Jul. 3, 2015, in corresponding European Patent Application No. 12862945.8.
Extended European Search Report—EP 16 15 6295—Apr. 6, 2016.

* cited by examiner

PRIOR ART

PRIOR ART

BATCH ANNEALING FURNACE FOR COILS

FIELD OF INVENTION

The present invention relates to a batch annealing furnace for coils configured to anneal a coil in which a steel sheet is cylindrically wound.

BACKGROUND OF INVENTION

Recently, for the sake of environmental measures, weight reduction and downsizing of various devices with better characteristics of steel materials have been required. For example, as an eco-friendly approach in the field of automobiles, there have been growing contradictory demands that exhaust gas should be reduced by improving fuel efficiency through weight reduction, safety should be secured by increasing strength against a collision, and costs should be reduced. As one solution to these, characteristics improvement including increasing the tensile strength of steel materials is an important subject. When electromagnetic steel sheets as a functional material are used as various devices, the issues of weight reduction and downsizing are inseparable. To solve these problems, improvement in electromagnetic characteristics is essential for the electromagnetic steel sheets.

As an example of the methods for improving the characteristics of a steel sheet, there is characteristics improvement by batch annealing. For example, in order to address the trouble of stretcher strain that can occur when cold-rolled steel sheets, which are generally used for automobiles and household electric appliances, are formed and a fluting phenomenon that can occur when cans are formed, these phenomena can be avoided by annealing and temper rolling.

The temper rolling and subsequent strain aging can vary depending on how annealing is performed. In other words, objectives differ according to the selection of batch annealing or continuous annealing. Because the batch annealing can take long heating and soaking times, carbon (C), nitrogen (N), and the like that are dissolved are easy to be precipitated. As a result, the batch annealing can obtain a steel sheet that is easy to be softened and has a characteristic of small aging effect. The continuous annealing works in reverse.

The batch annealing plays an extremely important role in the electromagnetic steel sheet. That is, for the electromagnetic steel sheet, annealing by a batch annealing furnace can achieve, not only precipitation of dissolved elements, but also characteristics of the electromagnetic steel sheet as the original purpose by performing recrystallization. In other words, for the electromagnetic steel sheet (that is cylindrically wound to be formed in a coil shape), annealing by the batch annealing furnace is an essential manufacturing process that cannot be omitted or replaced with any other processes.

However, a coil obtained by annealing contains some defects (defects such as "edge elongation" in the upper part of a coil, "edge distortion" in the lower part of a coil, "center elongation and longitudinal wrinkles" in the central part of a coil, and characteristics degradation such as inability to improve characteristics involving specific phase transformation). Given this situation, in order to use the defective coils as steel materials, as for shape defects, by passing the coils through a defect detection system or a tension leveler in a recoiling line, the coils are made usable as products with defects extracted, defective parts removed, and shapes corrected. Given these circumstances, coils obtained by annealing have had the problems of a decrease in yield before being made into products, a decrease in production efficiency, and high costs associated with inspection and shape correction.

When the coil obtained by annealing does not have characteristics as good as or better than predetermined characteristics in terms of the characteristics improvement, the coil is used with cutting off a deteriorated part. For this purpose, the coil has to be passed through an inspection line, marking and online cutting-off have to be performed, and the coil has to be wound again. This causes decreases in product pass rate and production efficiency. Because the coil is passed through the line again and is wound while performing characteristics measurement thereon, the cost for performing the measurement is added, leading to a significantly large cost increase.

Given these circumstances, the following various measures have been developed for such various problems in the batch annealing furnace. By performing these measures, the occurrence of defects after performing the measures can be reduced as compared with conventional cases.

For example, in a technology disclosed in Patent Literature 1, defects occurring inside a coil are observed and measures are carried out on the defects. In other words, the technology disclosed in Patent Literature 1, in order to reduce defects occurring in the lower part of the outer periphery of a coil, welds coils having different sheet thickness and performs recoiling so that a thicker sheet thickness is positioned on the outer side and a thinner plate thickness is positioned on the inner side, thereby forming one coil and performing annealing thereon.

A technology disclosed in Patent Literature 2, in order to resolve the sticking and loosening of a steel sheet as a coil, attempts to prevent the sticking and loosening by managing a temperature difference at cooling.

A technology disclosed in Patent Literature 3 refers to that the problem of seizure flaws can be resolved by making the structure of a batch annealing furnace a double structure equipped with an inner cover and setting a temperature condition of cooling speed to 5.0 to 15.0° C./Hr.

Patent Literature 4 discloses a method that, without managing the heating and cooling of a furnace in terms of speed, determines the relation between a critical stress at which seizure occurs at annealing and temperature in the radial direction, and based thereon, avoids flaws.

Patent Literature 5 and Patent Literature 6 disclose coil defects occurring at annealing in an annealing furnace and measures against the defects. For example, Patent Literature 5 discloses a method that prevents buckling in a coil by performing covering inside the coil. Patent Literature 6 discloses that defects occurring in a coil are resolved by forming a uniform temperature distribution within a furnace. Relating to this, the technology disclosed in Patent Literature 6 performs heating so as to give the uniform temperature distribution by covering or lining an inner cover of the furnace with a heat insulating material.

A technology disclosed in Patent Literature 7 forms a concave recess at the central part of an inner cover of a furnace and performs heating with this recess also from inside the coil at heating, thereby making a temperature distribution inside the coil uniform. The technology disclosed in Patent Literature 7 makes the temperature distribution within the coil uniform also at cooling by a similar effect. The technology disclosed in Patent Literature 7 discloses a method that can thereby reduce a stress occurring within the coil and reduce defects, and at the same time, reduce heating and cooling times and improve productivity.

Patent Literature 8 discloses a technology that puts a device that can perform heating and cooling of a coil into a furnace and heats and cools the inner and outer surfaces of the coil directly, thereby making a temperature within the coil uniform and improving productivity as well as a reduction in defects.

CITATION LIST

Patent Literature

Patent Literature 1: Japanese Patent Application Laid-open No. 59-35635

Patent Literature 2: Japanese Patent Application Laid-open No. 5-287390

Patent Literature 3: Japanese Patent Application Laid-open No. 5-295453

Patent Literature 4: Japanese Patent Application Laid-open No. 11-293348

Patent Literature 5: Japanese Patent Application Laid-open No. 2006-274343

Patent Literature 6: Japanese Patent Application Laid-open No. 2006-257486

Patent Literature 7: Japanese Patent Application Laid-open No. 2008-195998

Patent Literature 8: Japanese Patent Application Laid-open No. 2005-226104

Non Patent Literature

Non Patent Literature 1: "Tinplate and Tin Free Steel," published by Agne, written by Toyo Kohan Co., Ltd.

SUMMARY

Technical Problem

However, the technology disclosed in Patent Literature 1 is significantly inefficient in production, because when annealing a coil the coil having the thicker sheet thickness and the thinner sheet thickness is inevitably needed to be prepared. Furthermore, recoiling is also need to be performed, which not only complicates a process but also leads to a cost increase.

Although the technology disclosed in Patent Literature 2 attempts to prevent sticking and loosening by managing a temperature difference at cooling, the temperature difference management only at cooling does not give a fundamental solution, because defects actually occur also at heating and soaking.

Although the technology disclosed in Patent Literature 3 refers to that the problem of seizure flaws is resolved by making the structure of a batch annealing furnace a double structure equipped with an inner cover and setting a temperature condition of cooling speed to 5.0 to 15.0° C./Hr, its industrialization is difficult when considering efficiency, because the temperature decreases fairly slowly at cooling.

Although Patent Literature 4 discloses a method that determines a critical stress at which seizure occurs at annealing and performs annealing below the critical stress, the critical stress varies with the material and shape of a coil and further conditions of a batch annealing furnace. For this reason, stress calculation is needed at each time, needing much time and effort. In addition, because heating and cooling times are needed, a substantial time is required for performing annealing.

Although Patent Literature 5 discloses a technology that prevents buckling in a coil by covering inside the coil, the effect of a temperature distribution on buckling by the covering of the coil is unclear, and hence it is unclear whether coil defects are completely reduced.

Although the technology disclosed in Patent Literature 6 makes the temperature distribution within a furnace uniform by covering or lining an inner cover of the furnace with a heat insulating material, it is unclear whether an optimum coil temperature distribution is obtained when heating the inner cover covered with the heat insulating material. It is therefore unclear whether this measure completely reduces coil defects.

The technology disclosed in Patent Literature 7 forms a concave recess at the central part of an inner cover of a furnace and makes the temperature distribution inside the coil uniform in order to reduce defects, thereby reducing the time for heating and cooling. However, only forming the concave recess at the central part of the inner cover does not completely make the temperature within the coil uniform. As a result, this still produces a stress and is insufficient in manufacturing high-quality coils stably.

The technology disclosed in Patent Literature 8 puts a device that can perform heating and cooling of a coil into a furnace and heats and cools the inner and outer surfaces of the coil directly, thereby achieving the uniformity of a temperature within the coil and achieving improvement in productivity as well as a reduction in defects. However, such a constitution is much more costly in the device arranged within the furnace and operating it than conventional furnaces. As a result, this increases costs and offers no operational advantage.

Thus, although such various solutions exemplified in Patent Literature 1 to Patent Literature 8 have been developed for various defects (such as edge elongation, edge distortion, and longitudinal wrinkles) occurring in coils at annealing in the conventional batch annealing, there have been no fundamental solutions, and any existing solution results in a reduction in production efficiency and a cost increase when performed. As a result, under present circumstances, there is the alternative of taking inefficiency and a cost increase due to the occurrence of defects or reducing defects by the measures disclosed in the above literature and at the same time taking inefficiency and a cost increase.

The present invention has been achieved in order to solve the above problems, and an object thereof is to provide a batch annealing furnace configured to anneal a coil in which a steel sheet is cylindrically wound, the batch annealing furnace for coils reduces coil defects occurring when annealing a coil, ensures productivity, and is advantageous in terms of cost.

SUMMARY OF THE INVENTION

To solve the above-described problem, a batch annealing furnace for coils according to one aspect of the present invention is configured to anneal a coil in which a steel sheet is wound and includes: a coil support base on which an end face of the coil is mounted and that supports the coil with an axis of the coil being upright; an inner cover that covers an entire body of the coil mounted on the coil support base; and a cooling pipe that extends downward from an upper part of the inner cover to a cavity of an inner peripheral part of the coil mounted on the coil support base and cools the coil from an inner surface side by passing a coolant through inside of the cooling pipe.

Moreover, in the batch annealing furnace for coils according to one aspect of the present invention, the cooling pipe includes a double pipe including a cylindrical inner pipe and a cylindrical outer pipe that surrounds the inner pipe, the inner pipe serves as an introduction pipeline that introduces the coolant from the upper part of the inner cover toward the coil support base, and an area between the outer pipe and the inner pipe serves as a return pipeline that returns the coolant from the coil support base toward the upper part of the inner cover, and at a location where a direction of flow of the coolant passing through the introduction pipeline and the return pipeline changes, a bottom plate having a semispherical shape convex downward whose diameter is half the radius of the outer pipe or more reverses the direction.

Moreover, in the batch annealing furnace for coils according to one aspect of the present invention, the cooling pipe includes: an introduction pipeline that introduces the coolant from the upper part of the inner cover toward the coil support base; a curved pipeline that changes a direction of flow of the coolant introduced into the introduction pipeline toward the upper part of the inner cover; and a return pipeline that returns the coolant of which direction of flow has changed by the curved pipeline toward the upper part of the inner cover.

Moreover, in the batch annealing furnace for coils according to one aspect of the present invention, the return pipeline includes two or more return pipelines by causing the curved pipeline connected to the introduction pipeline to be divided into a plurality of pipes.

Moreover, in the batch annealing furnace for coils according to one aspect of the present invention, at least one of the introduction pipeline and the return pipeline has a diameter expanded toward downstream.

In the batch annealing furnace for coils according to one aspect of the present invention, the coolant is gas, which is preferably air, pure nitrogen gas, an inert gas such as pure argon or helium, a gas mixture of the inert gas and air in which an oxidative gas such as oxygen or fluorine is reduced, or a gas mixture of a reducing gas such as hydrogen or carbon monoxide and the inert gas.

Advantageous Effects of Invention

The present invention enables a batch annealing furnace for coils configured to anneal a coil in which a steel sheet is cylindrically wound to reduce defects (shape defects such as edge elongation (the coil upper part), edge distortion (the coil lower part), center elongation, longitudinal wrinkles, and steel sheet sticking and defects as characteristic degradation such as inability to improve characteristics involving specific phase transformation) occurring during annealing, improve process efficiency after coil annealing and productivity, reduce costs, and improve steel sheet characteristics.

In addition, adopting the present invention can reduce fluctuations in characteristics occurring in one coil, which has been conventionally impossible. This makes it possible to aim at higher characteristics in the annealing process and also expects improvement in the quality of products.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE INVENTION

Described first is how the present invention has been achieved. The inventors of the present invention made investigations on the cause of defects occurring in a coil in detail through the following process to determine a defect occurrence mechanism.

Figure 16:
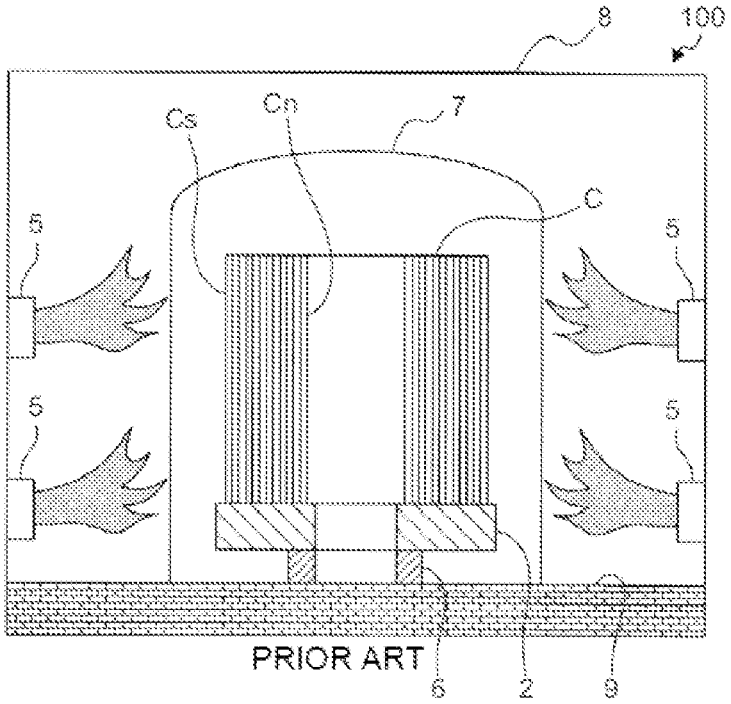
FIG. 16 is a schematic diagram (sectional view) illustrating an example of a conventional batch annealing furnace for coils.

FIG. 16 is a schematic diagram simply illustrating a structure of a conventional batch annealing furnace for coils (hereinafter also referred to as simply a "batch annealing furnace"). As illustrated in the drawing, this conventional batch annealing furnace 100, in order not to produce temperature unevenness within the furnace, heats an inner cover 7 within a furnace wall 8 from its outside by a plurality of burners 5 and also heats from a furnace bottom 9 side below a coil support base 2 supporting a coil C by a heater 6. This makes the temperature within the furnace nearly uniform. The heating is programmed in advance so as to follow target temperatures.

Temperature within a furnace has been conventionally measured to obtain a temperature distribution within the furnace, and a heating method and the structure of an outer wall of the surface have been changed so as to reduce the distribution. However, only doing so is insufficient, sometimes producing the defects. In this situation, the conventional manufacturing process cannot be omitted completely, resulting in failure in reduction in costs with increased productivity.

Given these circumstances, the inventors of the present invention also measured the temperatures of an inner peripheral part Cn of the coil C, the coil support base 2 supporting the coil C, and the like by thermocouples. At the same time, heat transfer calculation was performed to determine a temperature distribution also in an area for which temperature measurement was unable to be performed by the thermocouple, thereby measuring an influence on the coil C. This has brought about results that were considered unthinkable before.

In other words, it has been conventionally qualitatively considered that the temperature distribution in the inner peripheral part Cn of the coil C would cause elongation strain. As a result of the above heat transfer calculation, however, it has been found that the deformation of the coil C caused by the temperature distribution has larger effect on a plate shape than expected, and that defects such as edge elongation, edge distortion, center elongation, and longitudinal wrinkles, which have been conventionally considered to occur simply by thermal deformation, do not occur due to such a simple manner.

Figure 20:
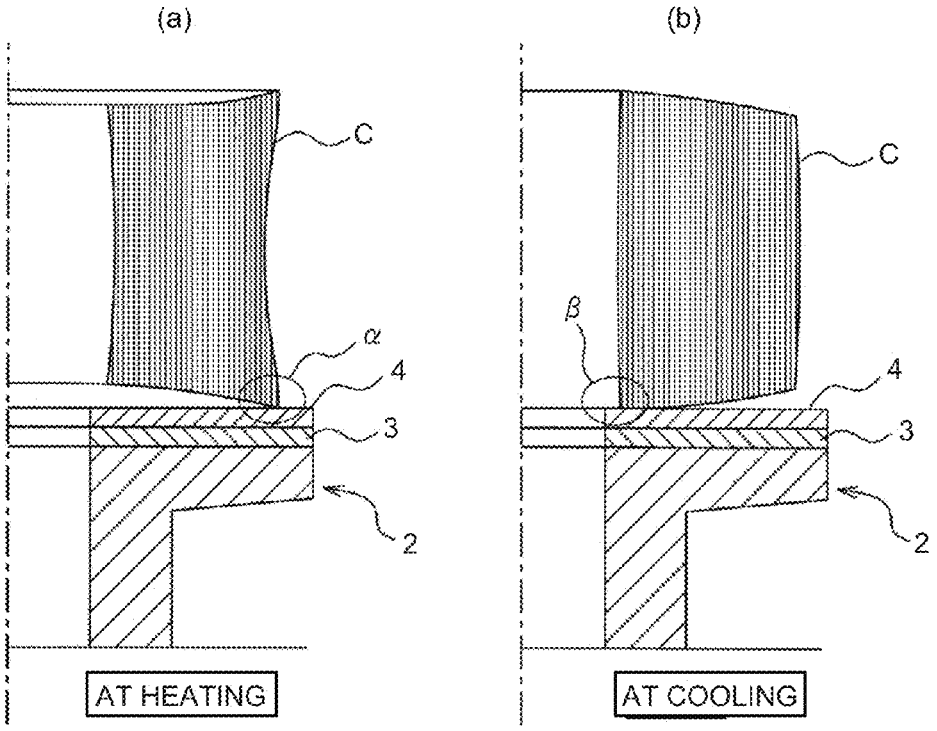
FIG. 20 are sectional views of the principal part illustrating the thermal expansion deformation of a coil in the conventional batch annealing furnace; (a) is at heating, whereas (b) is at cooling.

Specifically, when the inside of the furnace is heated from the furnace bottom 9 and outside the inner cover 7, the coil C within the furnace is heated by its thermal radiation to increase the temperature of an outer peripheral part Cs of the coil C first. For this reason, at heating, the outer peripheral part Cs of the coil C has larger thermal expansion than the inner peripheral part Cn, thereby, as represented by the symbol $\alpha$ in FIG. 20 (*a*), a lower end of the outer peripheral part Cs lifts and holds the coil C itself.

In addition, because at heating the temperature of the upper end of the outer peripheral part Cs of the coil C increases, a part corresponding to the coil upper end has a larger amount of thermal expansion, and similarly, the coil lower end elongates by thermal expansion. As a result, the central part of the wound steel sheet is elongated by being dragged by the upper and lower coil elongation, causing center elongation. The outward expansion of the lower end of the outer peripheral part Cs produces not only edge distortion by expansion, but also deformation caused by the fact that the weight of the coil C with an axial direction being upright is supported by this part. This also produces deformation caused by friction with the coil support base 2 (a spacer 4 arranged on an interposed cushion 3) below the coil C when the coil C expands.

Because at cooling the coil C is cooled by radiational cooling, the outer peripheral part Cs of the coil C is cooled first. For this reason, as represented by the symbol $\beta$ in FIG. 20 (*b*), the coil shape becomes deformed, and the weight of the entire body of the coil C is supported by the lower end of the inner peripheral part Cn of the coil C, leading to coil deformation at the lower end near the inner periphery. In other words, it has been found that attempt to prevent deformation when annealing the coil cannot be achieved simply by relaxation of a temperature increasing rate and a cooling rate or uniform thermal radiation from a furnace wall, which have been conventionally considered.

Figure 21:
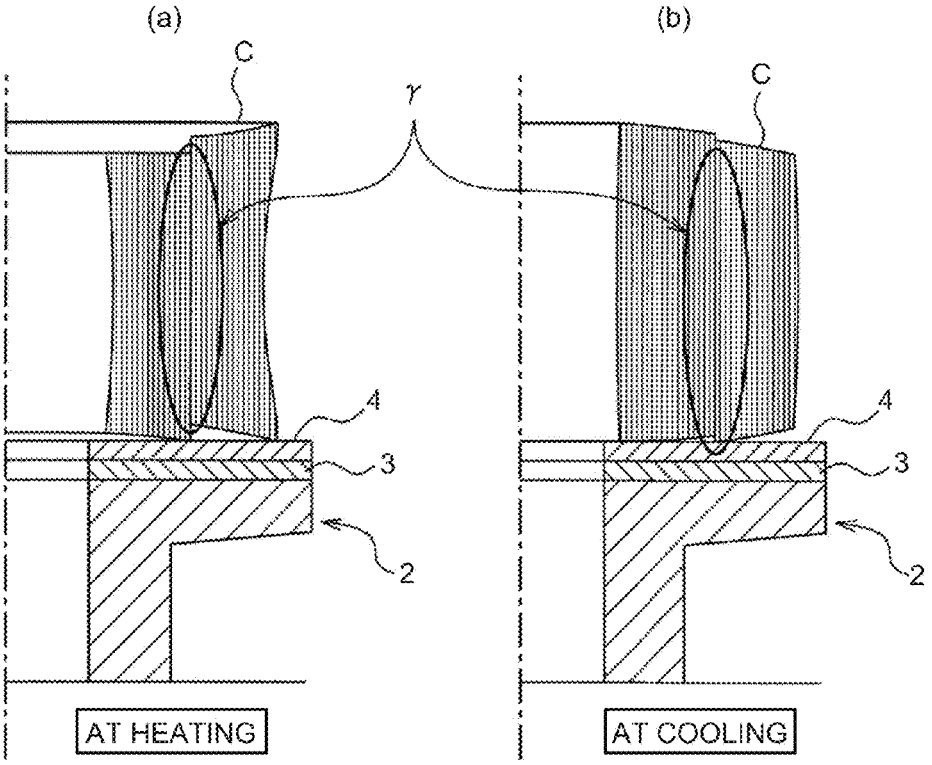
FIG. 21 are sectional views of the principal part illustrating "displacement deformation" occurring between the inside and the outside along with the thermal expansion deformation of a coil in the conventional batch annealing furnace; (a) is at heating, whereas (b) is at cooling.

In addition, as for new defects (a sticking phenomenon of a sheet during annealing) from an unknown cause, the cause has been clarified by a temperature measurement experiment and analysis for these defects. There have been a phenomenon in which a steel sheet as part of a coil sticks after annealing, and its cause has not been known so far. This time, by performing temperature measurement and heat transfer calculation, it has been found that the coil C is deformed by thermal expansion as illustrated in FIG. 21. In other words, as represented by the symbol $\gamma$ in FIG. 21 (*a*) and FIG. 21 (*b*), it has been found that "displacement" in a steel sheet may occur in the axial direction of the coil C while annealing the coil C. With respect to this result, when the size of the "displacement" in the steel sheet at the part where the coil sticks was measured, it has been found that the size is nearly the same as the size of deformation obtained by calculation. Although it cannot be determined in general because various cases can cause this "displacement", it is clear from this result that the occurrence of the "displacement" is caused by the thermal deformation and the thermal stress of the coil.

It has been found that the thermal deformation and the thermal stress also relate to characteristics deterioration in annealing. In other words, the phase transformation for characteristics improvement takes place from heating to soaking of the coil C. In general, in the coil C, the outer peripheral part Cs is first heated by radiation, and at the same time, the inner peripheral part Cn is also heated by radiation. In particular, when attempting to increase the coil temperature up to a target temperature quickly, radiation reaches the inner peripheral part Cn of the coil C, and the temperature within the coil C also increases. When heated also from the furnace bottom 9 in order to increase a temperature increasing rate, radiation is effected from the furnace bottom 9, thereby further heating the inner peripheral part Cn of the coil C and giving a larger temperature increase from the inside. Owing to this, even when heating from the outer peripheral part Cs, a compressive stress is produced within the coil by the expansion of the inner peripheral part Cn, which is considered to cause the coil C to be lifted. When the value is large at the same time, a compressive stress is produced within the coil, which is considered to cause the progress of phase transformation to be hindered.

Figure 9:
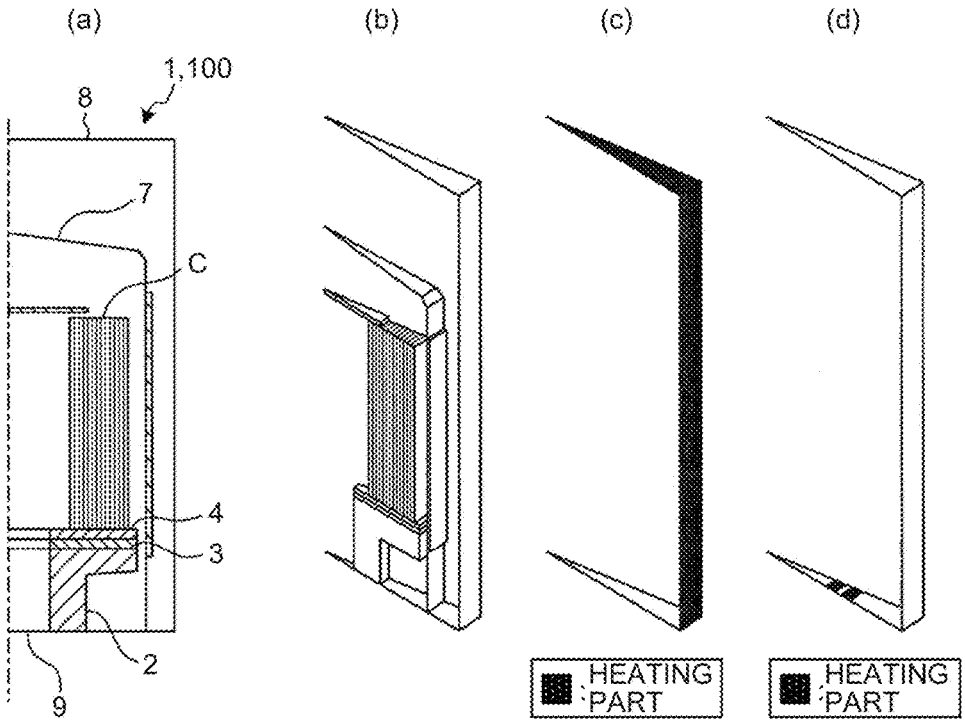
FIG. 9 is a drawing illustrating an example of a heat transfer calculation model.

FIG. 9 is a diagram illustrating a heat transfer calculation model used in the above heat transfer calculation. FIG. 9 (*a*) illustrates an example of a right half (½) of a section of a batch annealing furnace (the batch annealing furnace 100 in FIG. 16 or a batch annealing furnace 1 in FIG. 1 described below) and the coil C. Based on this FIG. 9 (*a*), 15° from the center is modeled as periodic symmetry (illustrated in FIG. 9 (*b*)). Heating parts are arranged on the wall surface of the furnace wall 8 (illustrated in FIG. 9 (*c*)) and parts of the furnace bottom 9 (illustrated in FIG. 9 (*d*)). A thermal flux from the burner 5 of the furnace wall 8 is given to the heating part on the wall surface in FIG. 9(*c*). The heating parts on the furnace bottom 9 in FIG. 9 (*d*) set areas in which heating is actually performed with a heating wire and gives a heat flux by the heating wire. Using this heat transfer calculation model, an internal temperature distribution of the coil C is determined by a finite element method, and from the result of this internal temperature distribution, an internal stress of the coil C is determined by numerical calculation. The calculation of the internal stress of the coil C is performed in coupling with the heat transfer calculation; in order to reduce a calculation time, the calculation is performed with weak coupling on the assumption that a local difference of heat expansion is small. As for the internal stress of the coil C, because the influence of high-temperature creep cannot be negligible, the internal stress calculation is performed using data on high-temperature creep in addition to the internal temperature distribution. In addition, as for the coil support base 2, the cushion 3, and the spacer 4 receiving the coil C, heat transfer calculation is also performed concurrently in order to calculate a temperature distribution, and based on this temperature calculation, deformation by heat is calculated. Also considered is the influence of the contact of the coil support base 2, the cushion 3, and the spacer 4 that have been deformed by heat with the coil C. Heat transfer calculation, which will be described below, on the batch annealing furnace 1 (FIG. 1 to FIG. 3) as an embodiment according to the present invention and the batch annealing furnace 100 (FIG. 16 to FIG. 19) as a conventional example and the internal stress calculation of the coil C are performed with the batch annealing furnace as the base of modeling appropriately replaced with the batch annealing furnace 1 or the batch annealing furnace 100 in FIG. 9 (*a*) by a similar method with a similar model created.

Based on the above knowledge about the defect occurrence mechanism, the inventors of the present invention have achieved the present invention. The following describes an embodiment of a batch annealing furnace according to one aspect of the present invention. This batch annealing furnace performs annealing on a coil in which a steel sheet is cylindrically wound in order to provide the steel sheet with various characteristics.

Figure 1:
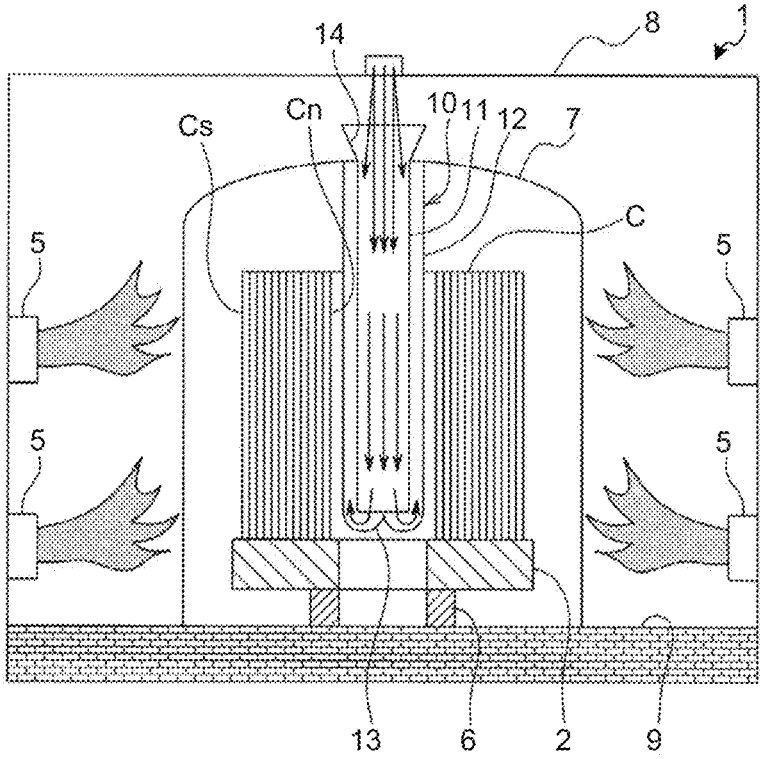
FIG. 1 is a schematic diagram (sectional view) illustrating a first embodiment of a batch annealing furnace according to one aspect of the present invention.

FIG. 1 illustrates a schematic diagram of a first embodiment of a batch annealing furnace according to one aspect of the present invention. The structure of the batch annealing furnace according to one aspect of the present invention will be described with reference to the schematic diagrams of the conventional batch annealing furnace illustrated in FIG. 16 and FIG. 19 for comparison. Including the above description, similar or corresponding components will be indicated by the same reference symbols.

A big difference between the batch annealing furnace 1 according to the present embodiment illustrated in FIG. 1 and the conventional batch annealing furnace 100 illustrated in FIG. 16 (FIG. 19) is that the batch annealing furnace 1 according to the present embodiment includes a cooling pipe 10, which is not included in the conventional batch annealing furnace 100, in the inner peripheral part Cn of the coil C.

Specifically, as illustrated in FIG. 1, the batch annealing furnace 1 according to the present embodiment and the conventional batch annealing furnace 100 include the coil support base 2 within the furnace wall 8. The coil support base 2 is a base on which an end face of the coil C is mounted and that supports the coil C with an axis of the coil C being upright. The coil C is mounted on the top surface of the coil support base 2 through the cushion 3 and the spacer 4 (the cushion 3 and the spacer 4 are not illustrated in FIG. 1). The inner cover 7 is arranged within the furnace wall 8 so as to collectively cover the coil C and the coil support base 2. In order not to produce temperature unevenness within the furnace, the inner cover 7 within the furnace wall 8 is heated from its outside by the burners 5 and is also heated from the furnace bottom 9 side below the coil support base 2 supporting the coil C by the heater 6. This makes the temperature within the furnace nearly uniform. The heating is programmed in advance so as to follow target temperatures.

The batch annealing furnace 1 according to the present embodiment includes the cooling pipe 10 that extends downward from the upper part of the inner cover 7 to a cavity of the inner peripheral part Cn of the coil C mounted on the coil support base 2 and cools the coil C from the inner surface side by passing a coolant through the inside of the cooling pipe 10. The cooling pipe 10 according to the present embodiment is a double pipe including a cylindrical inner pipe 11 and a cylindrical outer pipe 12 that surrounds the inner pipe 11. The inner pipe 11 is an introduction pipeline that introduces the coolant from the upper part of the inner cover 7 toward the coil support base 2, and an area between the outer pipe 12 and the inner pipe 11 is a return pipeline that returns the coolant from the coil support base 2 toward the upper part of the inner cover 7. The cooling pipe 10 reverses the direction of a flow by a bottom plate 13 having a semispherical shape convex downward whose diameter is half the radius of the outer pipe 12 or more at a location (the lowermost position in the drawing) where the direction of the flow of the coolant passing through the introduction pipeline and the return pipeline changes. An opening (an inlet for the coolant to be passed through the cooling pipe 10) 14 at the upper part of the inner pipe 11 is formed in a funnel shape whose diameter expands toward the upper part.

The coolant to be passed through the cooling pipe 10 is gas, which is preferably air, pure nitrogen gas, an inert gas such as pure argon, or helium, a gas mixture of the inert gas and air in which an oxidative gas such as oxygen or fluorine is reduced, or a gas mixture of a reducing gas such as hydrogen or carbon monoxide and the inert gas.

Figure 19:
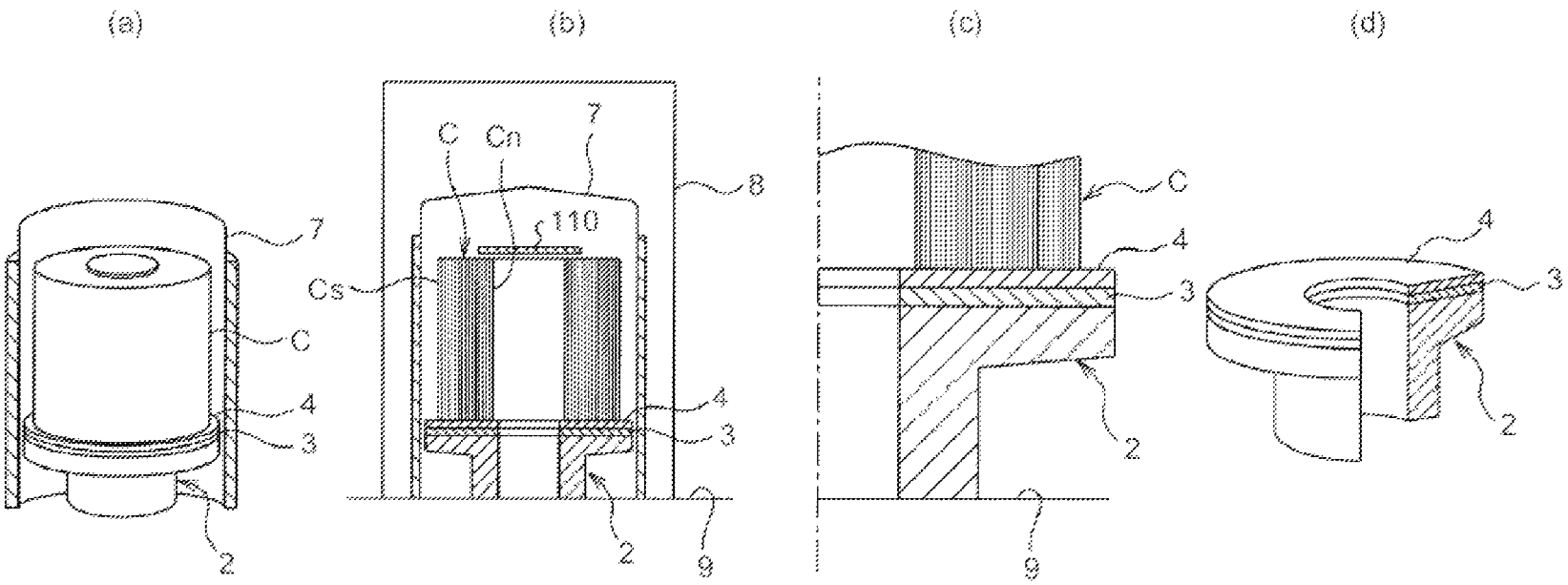
FIG. 19 are drawings for illustrating an example of a structure (a solid structure) of the conventional batch annealing furnace: (a) is a perspective view of the entire furnace; (b) is a sectional view in the axial direction; (c) is an enlarged view of the principal part of (b); and (d) is a drawing illustrating the part of a coil support base in (a) with a part cut away.

Descries next are differences in effects between the batch annealing furnace 1 according to the present embodiment illustrated in FIG. 1 and the conventional batch annealing furnace 100 illustrated in FIG. 16 (FIG. 19).

As illustrated in FIG. 16, the coil C has been conventionally annealed with the inner peripheral part Cn of the coil C being a mere cavity. As a result, the coil C is heated plainly with radiation from the inner cover 7 and radiation from the heater 6 on the furnace bottom 9, and when attempting to increase the coil temperature up to a desired temperature, the temperature of the inner peripheral part Cn of the coil C has been inevitably increased. In this situation, as illustrated in FIG. 19 (*b*), in an attempt to reduce the temperature of the inner peripheral part Cn of the coil C, radiant heat has been conventionally prevented from entering the cavity of the inner peripheral part Cn by arranging a heat insulating material 110 above the coil C. However, because this has been less than perfect to effect radiation even through the heat insulating material 110, and the radiation from the heater 6 on the furnace bottom 9 has also been effected, the temperature inside the coil has been inevitably increased.

In this situation, heating has been conventionally performed with a low temperature increasing rate in order to perform heating so that the inner peripheral part Cn of the coil C is maintained at a lower temperature than the outer peripheral part Cs. However, because the temperature of the inner peripheral part Cn of the coil C is inevitably high during the intra-furnace cooling, it is necessary to perform cooling with a temperature distribution reduced to the extent that coil quality is not affected by reducing a cooling rate. This has been a further cost increase.

In contrast, in order to achieve simultaneously a reduction in annealing time and the maintenance of high quality, the batch annealing furnace 1 according to the present embodiment arranges the cooling pipe 10 within the cavity of the inner peripheral part Cn of the coil C to make a structure that arranges the coils C outside the cooling pipe 10. Thus, the batch annealing furnace 1 extends the cooling pipe 10 downward from the upper part of the inner cover 7 to the cavity of the inner peripheral part Cn of the coil C mounted on the coil support base 2 and passes the coolant through the cooling pipe 10, thereby cooling the coil C from the inner surface side and reducing a temperature increase inside the coil.

Although it is considered that at first glance this batch annealing furnace 1 only includes the cooling pole 10 as compared with the conventional batch annealing furnace 100 illustrated in FIG. 16, there is a great difference therebetween.

Specifically, in the present embodiment, as illustrated by the schematic diagram in FIG. 1, the cooling pipe 10 is arranged within the cavity of the inner peripheral part Cn of the coil C, and the coolant (cooling gas) is passed through the cooling pipe 10 to cool the coil C from its inner peripheral part Cn side. In other words, the cooling pipe 10 of the batch annealing furnace 1 does not directly blow the cooling gas within the furnace, but cools the coil C from inside through radiant heat transfer. The present embodiment, by applying this at heating, enables heating without producing a thermal stress within the coil, and at cooling, enables cooling efficiently at a higher rate than a conventional cooling rate by cooling the coil C from inside.

In contrast, the conventional batch annealing furnace 100 illustrated in FIG. 16 only heats the inner cover 7 from outside by the burners 5 to heat the coil C with the radiant heat of the inner cover 7. As a result, depending on the material of the coil, at the heating, heating and cooling are needed so as to give a stress within a range of not affecting quality inside the coil C, thereby increasing the annealing time. As a result, the conventional batch annealing furnace 100 fails to produce a similar effect to the batch annealing furnace 1 according to the present embodiment.

Figure 17:
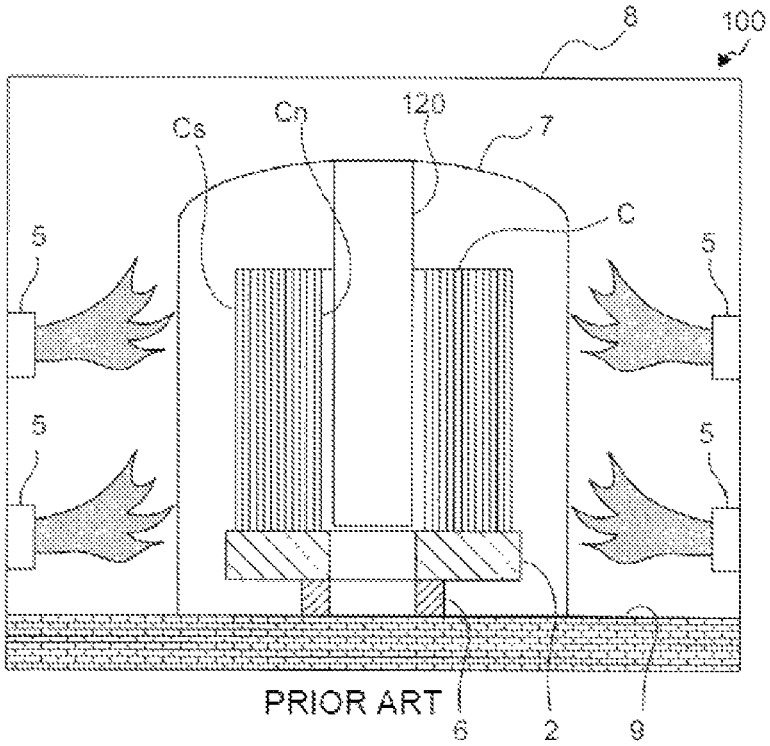
FIG. 17 is a schematic diagram (sectional view) of a first comparative example for illustrating another example of the conventional batch annealing furnace.

A first comparative example illustrated in FIG. 17 is an example that extends a mere cylindrical cooling pipe 120 downward to the inside of a coil. This example does not perform active heating and cooling as with the one disclosed in Patent Literature 7. As a result, heated gas enters a gap (recess) between the cooling pipe 120 and the inside of the coil at heating, thereby causing the inside of the coil to be heated, leading to a reduction in a heating time. The same holds true for at cooling. In other words, as Patent Literature 7 illustrates a temperature distribution, this constitution results in a temperature distribution that is convex downward at heating and that is convex upward at cooling in the thickness direction. This still produces a stress, and in order to avoid the stress, it is needed to set heating and cooling rates, which makes this constitution deficient. As a result, the first comparative example still cannot produce a similar effect to that of the batch annealing furnace 1 according to the present embodiment.

Figure 18:
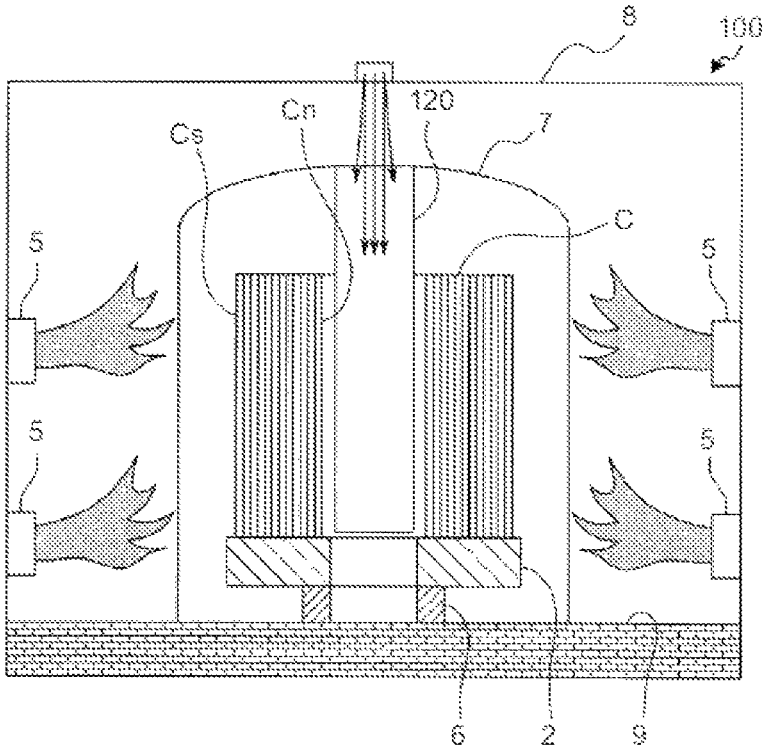
PRIOR ART FIG.18
FIG. 18 is a schematic diagram (sectional view) of a second comparative example for illustrating the batch annealing furnace for coils according to one aspect of the present invention.

Although a second comparative example illustrated in FIG. 18 attempts to achieve a similar effect to the effect produced by the constitution of the batch annealing furnace 1 according to the present embodiment by actively passing a coolant through the mere cylindrical cooling pipe 120, the mere cylindrical cooling pipe 120 does not cause gas as the coolant to enter the pipe smoothly. As a result, the second comparative example still cannot produce a similar effect to that of the batch annealing furnace 1 according to the present embodiment.

Next, in order to verify the effect of the batch annealing furnace 1 according to the present embodiment illustrated in FIG. 1, the shape of the cooling pipe 10 of the batch annealing furnace 1 as a first embodiment and the shapes of cooling pipes of other embodiments according to the present invention were compared with each other by numerical calculation to confirm the effect. Schematic diagrams of comparative shapes (the other embodiments according to the present invention) are illustrated in FIG. 2 and FIG. 3.

Figure 2:
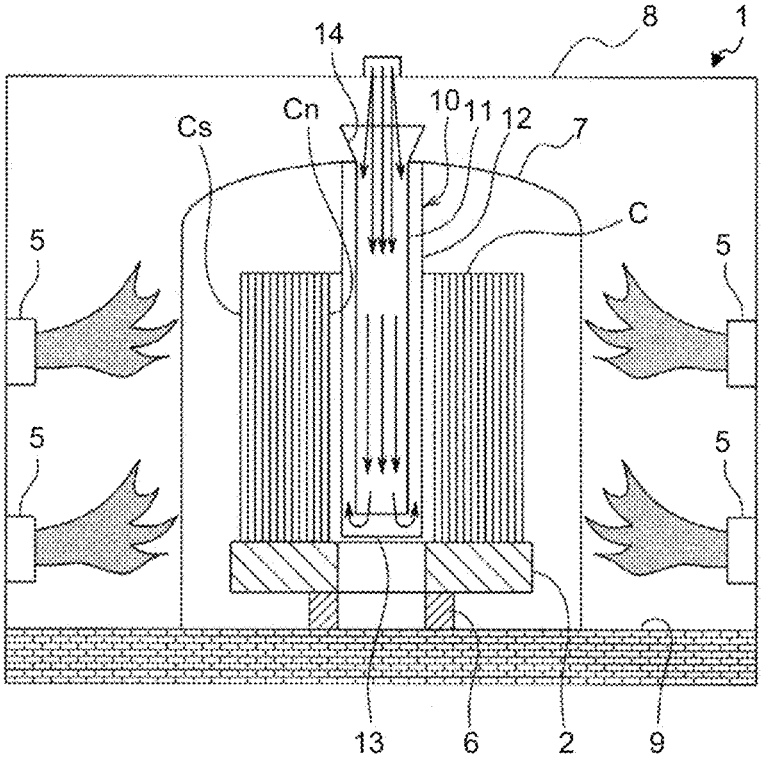
FIG. 2 is a schematic diagram (sectional view) illustrating a second embodiment of the batch annealing furnace according to one aspect of the present invention.
Figure 3:
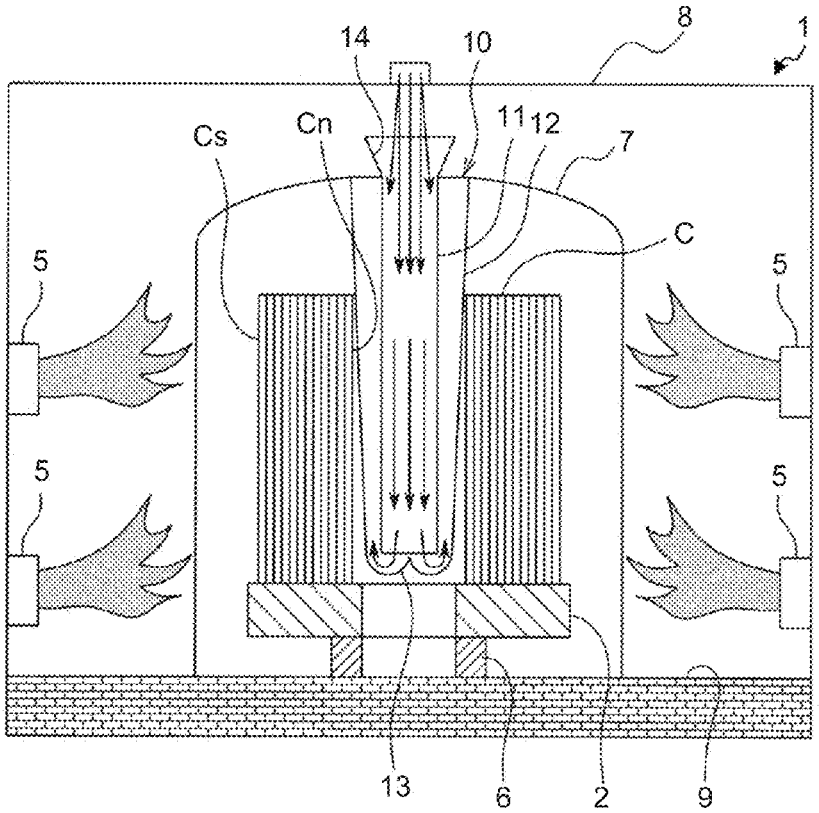
FIG. 3 is a schematic diagram (sectional view) illustrating a third embodiment of the batch annealing furnace according to one aspect of the present invention.
Figure 4:
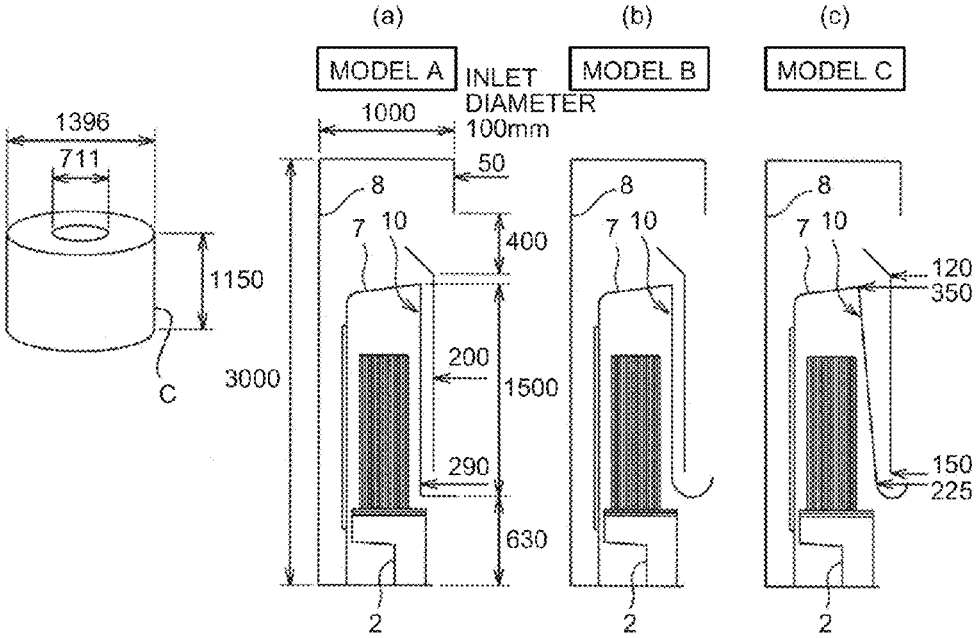
FIG. 4 is a drawing illustrating a comparison of flows in the embodiments of the batch annealing furnace according to one aspect of the present invention; the drawing indicates dimensions of models studied.

A second embodiment illustrated in FIG. 2 is an example that replaces the bottom plate having a semispherical shape convex downward attached to the lower part of the cooling pipe 10 of the first embodiment illustrated in FIG. 1 with a flat plate. A third embodiment illustrated in FIG. 3 adopts the bottom plate of the first embodiment illustrated in FIG. 1 (the semispherical shape convex downward whose diameter is half the radius of the outer pipe or more) and expands the diameter of the outer pipe toward the upper part. Specific model shapes used in the calculation are illustrated in FIG. 4 for comparison, and results related to the calculation are illustrated in FIG. 5 to FIG. 8. FIG. 4 omits the indication of the corresponding same dimensions. The correspondence relations between the embodiments according to the present invention and the respective models are as follows: a model A corresponds to the second embodiment (FIG. 2); a model B corresponds to the first embodiment (FIG. 1); and a model C corresponds to the third embodiment (FIG. 3).

Figure 5:
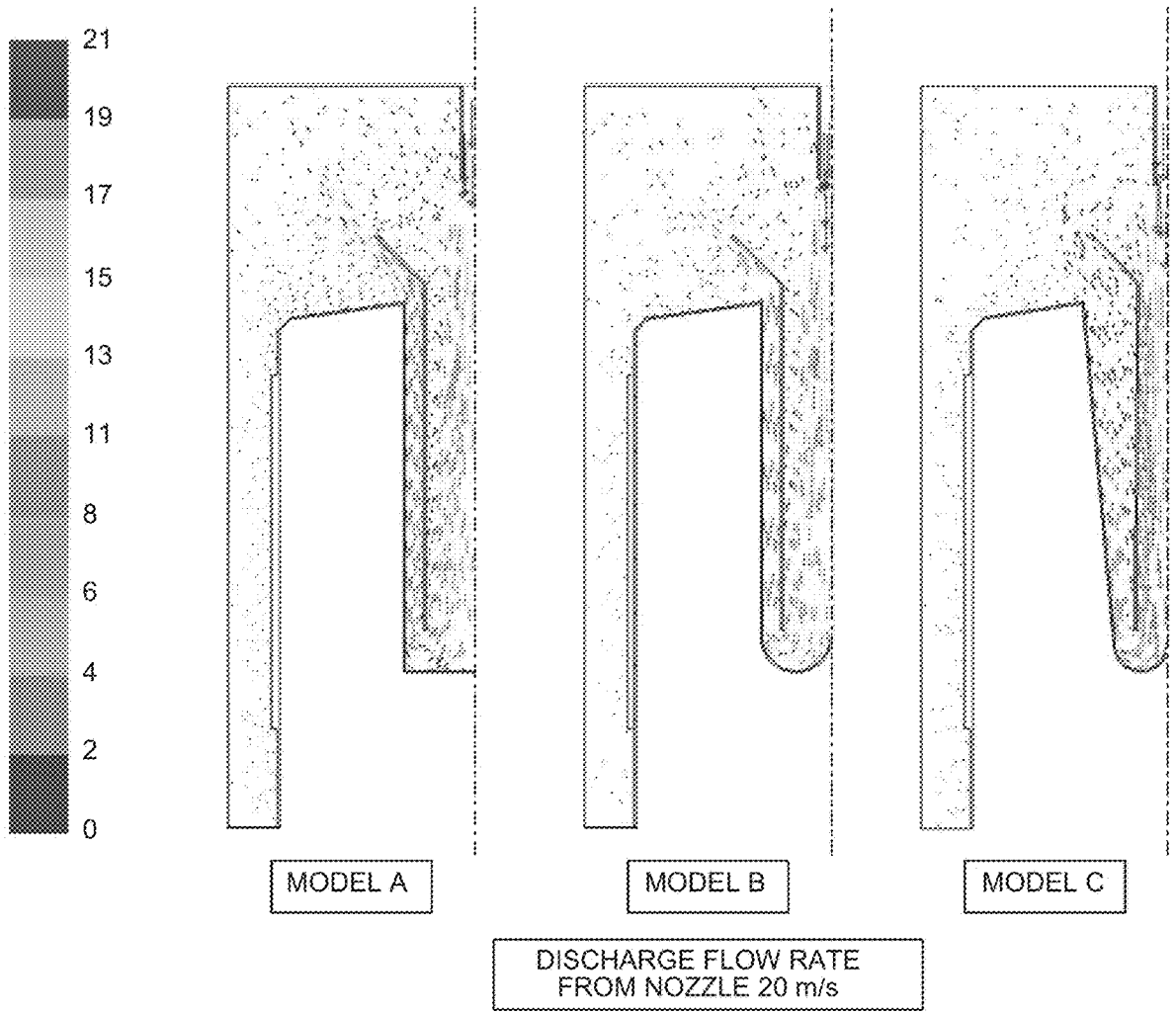
FIG. 5 illustrates an image of differences in discharge flow (a flow rate of 20 m/s) in the models studied in FIG. 4.
Figure 6:
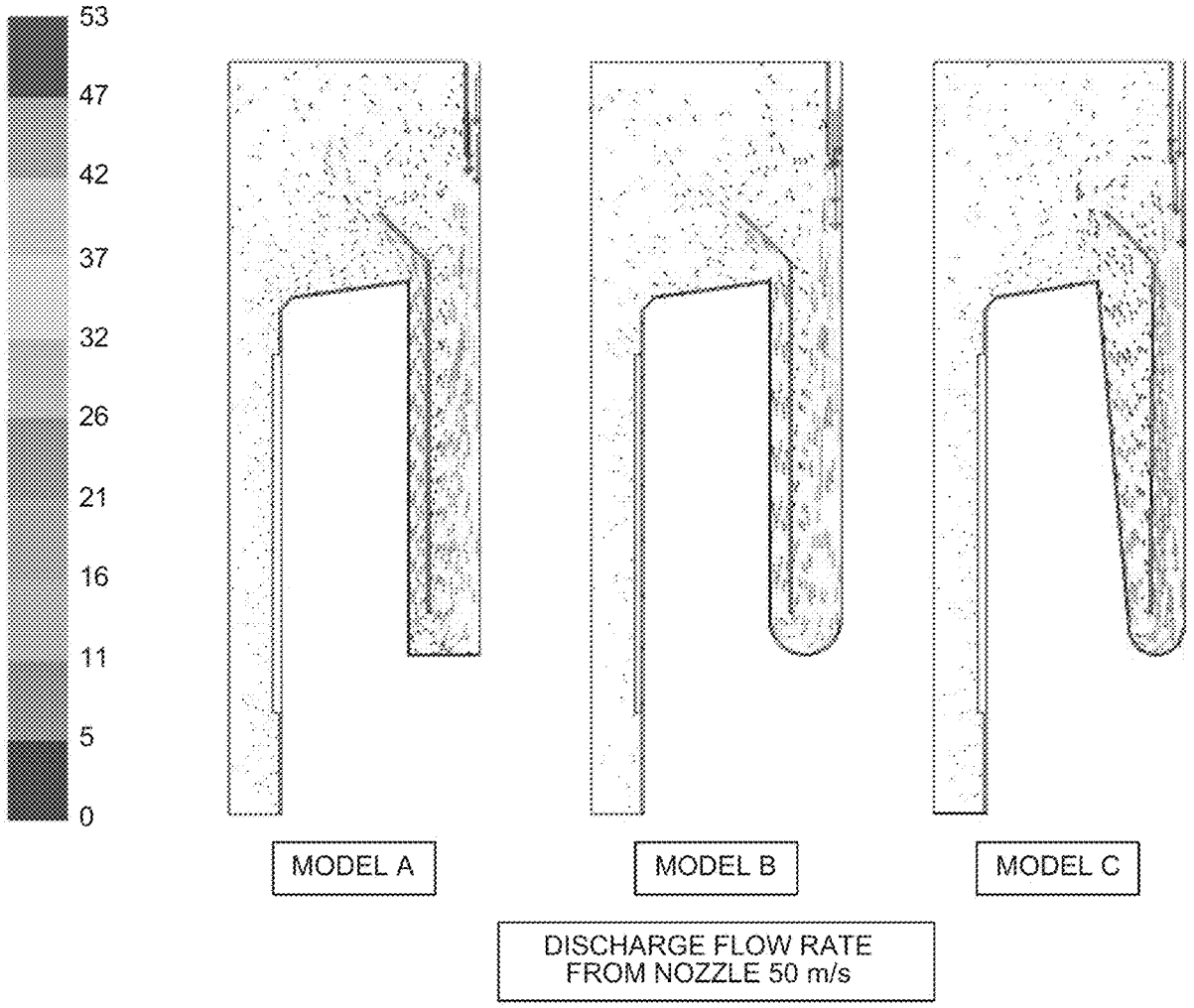
FIG. 6 illustrates an image of differences in discharge flow (a flow rate of 50 m/s) in the models studied in FIG. 4.

FIG. 5 illustrates flow rate distributions at a discharge rate from a nozzle of 20 m/s, whereas FIG. 6 illustrates flow rate distributions at a discharge rate from the nozzle of 50 m/s for each model. It has been found from the simulation results illustrated in FIG. 5 and FIG. 6 that the bottom of the cooling pipe 10 formed as the semispherical shape convex downward (the models B and C) gives higher flow rates of the gas at the bottom than the bottom of the cooling pipe 10 formed as the flat plate (the model A), and in particular, the model C that expands the diameter of the outer pipe toward its downstream side (upper part) gives the highest flow rate at the bottom of the cooling pipe 10.

Figure 7:
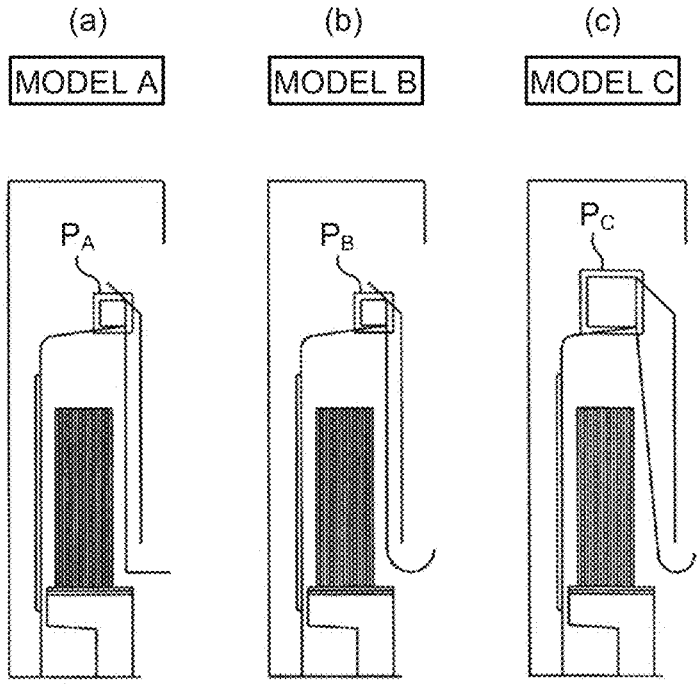
FIG. 7 illustrates an image of differences in the displacement of gas passing through a discharge part in the models studied in FIG. 4.
Figure 8:
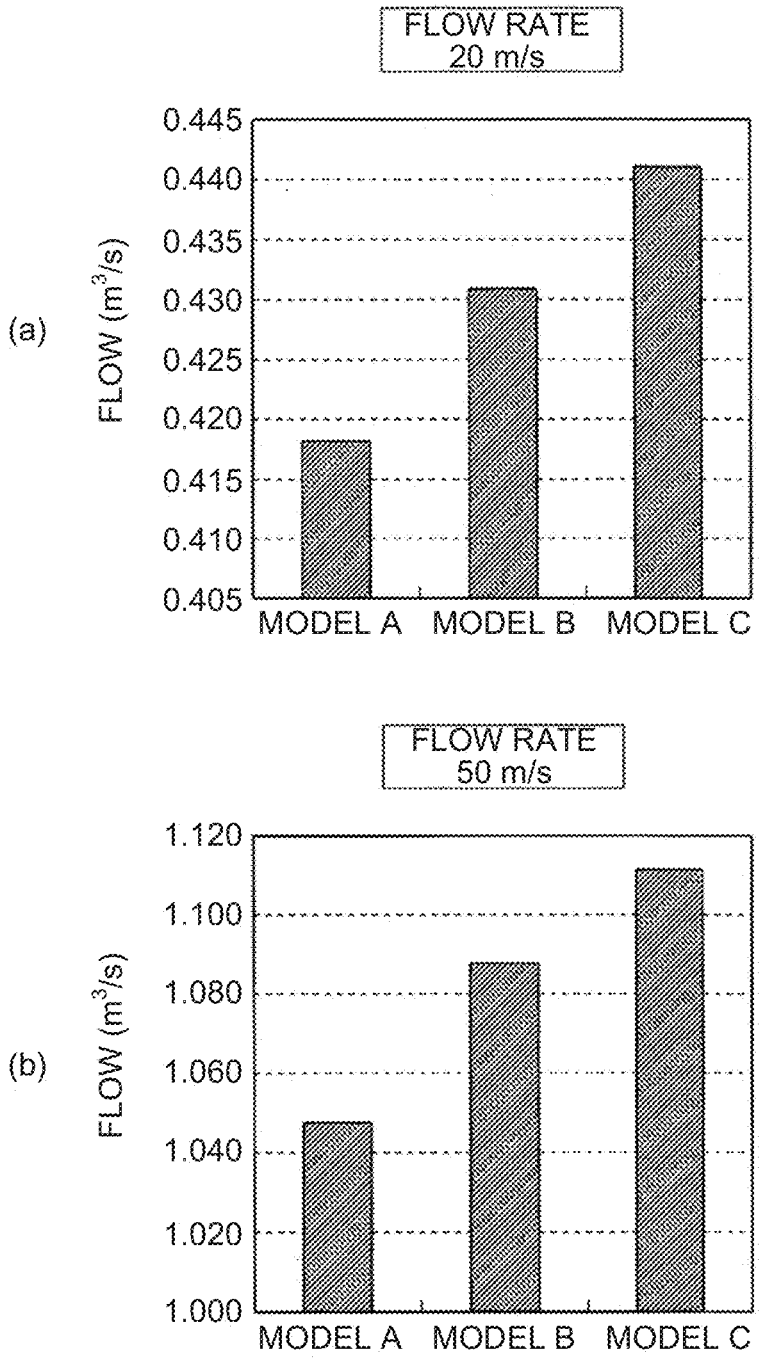
FIG. 8 are graphs illustrating differences in the displacement of gas passing through the discharge part in the models studied in FIG. 4; (a) is an example of discharge flow: a discharge flow rate of 20 m/s, whereas (b) is an example of discharge flow: a discharge flow rate of 50 m/s.

In addition, a gas flow in the vicinity of the opening (the volume of the gas passing through the vicinity of the opening) was compared among the models. Flow rate measurement positions $P_A$, $P_B$, $P_C$ in the vicinity of the opening of the respective models are illustrated in FIG. 7, and comparison results thereof are illustrated in FIG. 8. It has been confirmed from these results that the bottom of the cooling pipe 10 formed as the semispherical shape convex downward (the models B and C) gives a larger flow than the bottom of the cooling pipe 10 formed as the flat plate (the model A) and that expanding the diameter of the outer pipe toward the downstream side (upper part) (the model C) further increases the flow.

In other words, it is preferable to make the bottom shape of the cooling pipe 10 a smooth semispherical shape convex downward (the first embodiment) for the second embodiment as the constitution cooling the coil C from inside. This enables more effective cooling of the coil C. In addition, expanding the diameter of the outer pipe toward the downstream side (upper part) (the third embodiment) makes it possible to achieve a further cooling effect.

As illustrated in FIG. 1, the embodiments according to one aspect of the present invention installs the cooling pipe 10 at the center of the furnace and passes the coolant through the cooling pipe 10. This can cool the coil C from inside when heating and cooling the coil C, thereby practically eliminating a stress occurring inside the coil C, and as a result, can reduce deformation caused by the temperature unevenness of the coil C, and in particular, can prevent coil defects occurring on the inner periphery and the outer periphery of the coil C (shape defects such as edge elongation (the coil upper part), edge distortion (the coil lower part), center elongation, longitudinal wrinkles, and steel sheet sticking and defects as characteristic degradation such as inability to improve characteristics involving specific phase transformation) and can obtain sheet products having favorable shapes obtained thereby.

EXAMPLE

The following describes an example. An electromagnetic steel sheet is exemplified as a functional material that anneals a coil in which a steel sheet is cylindrically wound. In this case, a stricter condition is added; that is a magnetic property. When there is an excessive internal stress at annealing, recrystallized state deteriorates, and the magnetic property remarkably deteriorates. In view of this, the present example made confirmation with an electromagnetic coil that is sensitive to stress.

The present example employs a small-sized experimental furnace in order to study characteristics deterioration caused by faulty recrystallization during annealing occurring in a conventional coil. In an annealing test by this small-sized experimental furnace, a part of a steel sheet was cut out as a single sheet, and a stress corresponding to a stress occurring inside a coil was applied to the single sheet in advance. When the single sheet was heated in the small-sized experimental furnace, a state of recrystallization by phase transformation of this single sheet (steel sheet) was observed. Characteristics at that time were also measured. Using measurement related to the magnetic property of the electromagnetic steel sheet that is recrystallized by annealing and whose characteristics can be evaluated remarkably, an evaluation of annealing was performed. As a result, it has been found that a higher stress causes characteristics deterioration; the value was about 10 MPa.

Figure 10:
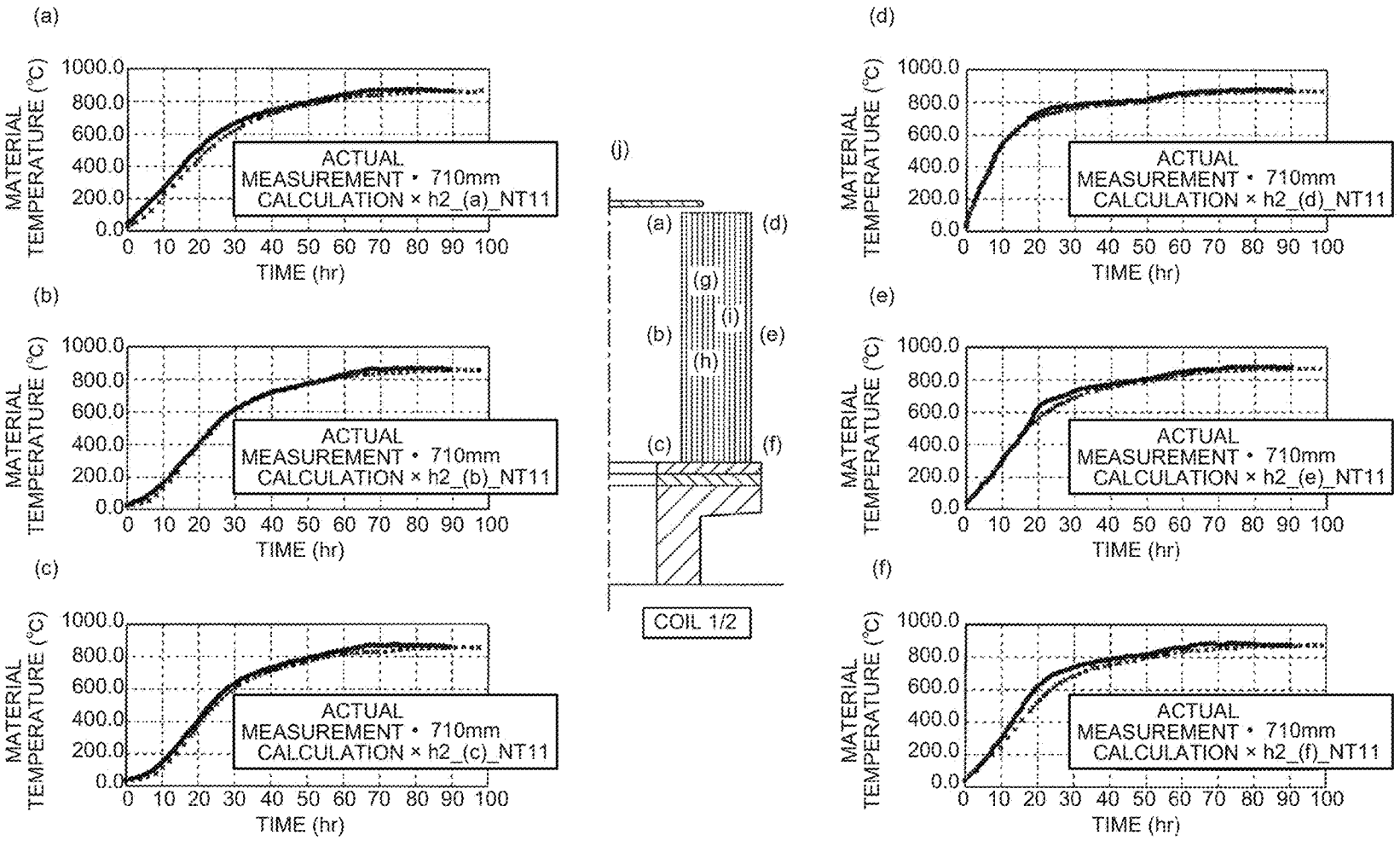
FIG. 10 are graphs ((a) to (f)) illustrating calculated temperature results and actually measured temperature results in combination for the sake of comparison and a drawing ((j)) illustrating positions on a coil corresponding to the graphs.
Figure 11:
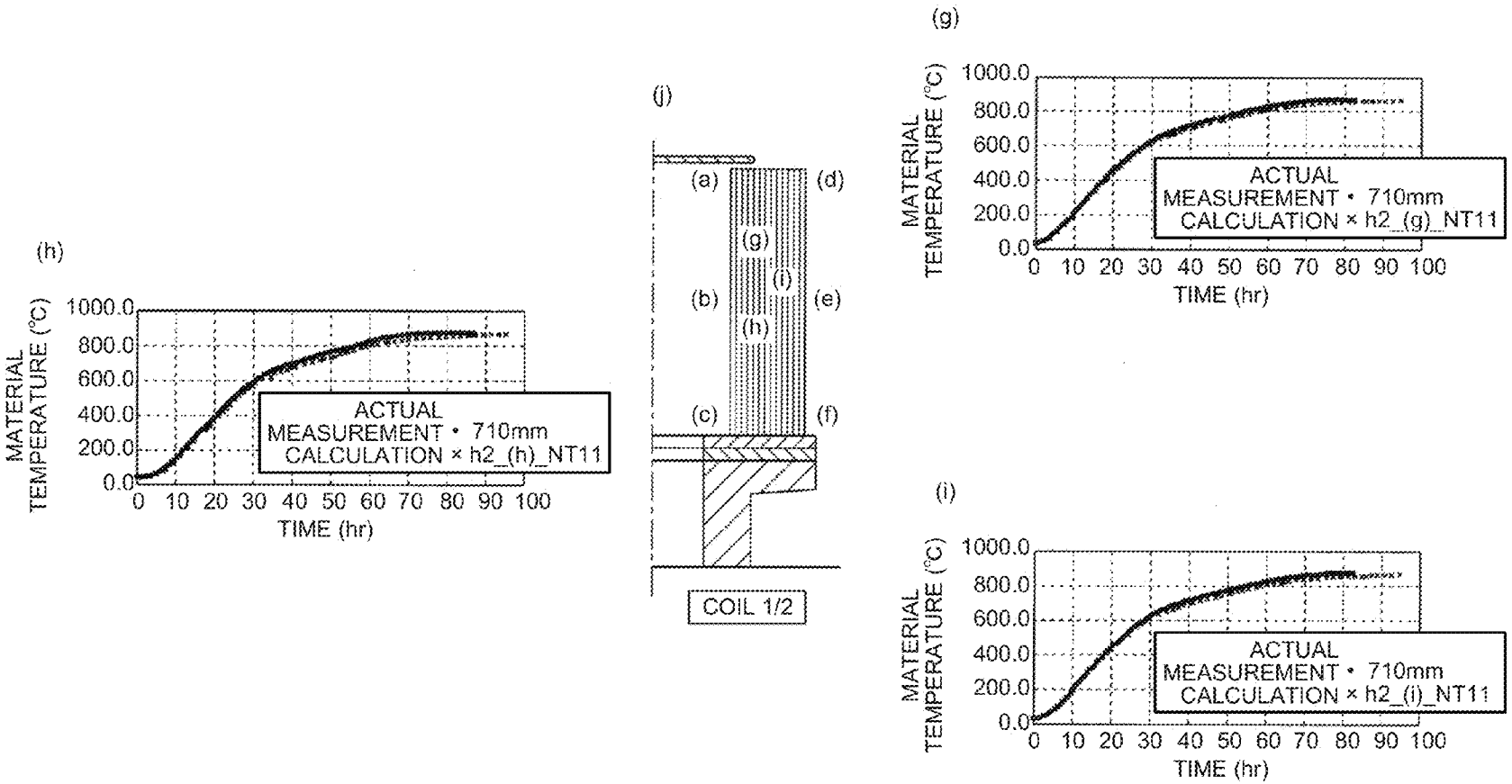
FIG. 11 are graphs ((g) to (i)) illustrating calculated temperature results and actually measured temperature results in combination for the sake of comparison and a drawing ((j)) illustrating positions on a coil corresponding to the graphs.

Based on the above result, an annealing experiment was performed by a real furnace (coil shape: a sheet width of 1,000 mm; a sheet thickness of 300 μm; a coil weight of 8 tons; and an inner diameter of 508 mm). In addition to a conventional temperature pattern, in order to enable a stress in the real furnace to be performed at the above 10 MPa or less, annealing was performed with a heating pattern studied at heat transfer calculation in advance. In performing the real furnace experiment, in order to check whether a temperature distribution obtained by the heat transfer calculation and an experimental value match, a coil was wound with thermocouples put into the coil, and the coil was put into a batch annealing furnace to perform a temperature measurement experiment at the same time. The results are illustrated in FIG. 10 and FIG. 11. The symbol (j) in FIG. 10 and FIG. 11 indicates temperature measurement positions in the coil C. The symbols of graphs in FIG. 10 and FIG. 11 correspond to the symbols of the temperature measurement positions indicated in (j). From the results illustrated in FIG. 10 and FIG. 11, it is found that the temperature measurement results and the results of the temperature distribution of the coil obtained by the heat transfer calculation matched well, which established the validity of the heat transfer calculation method. In view of this, analysis was performed using numerical calculation from there on.

Figure 12:
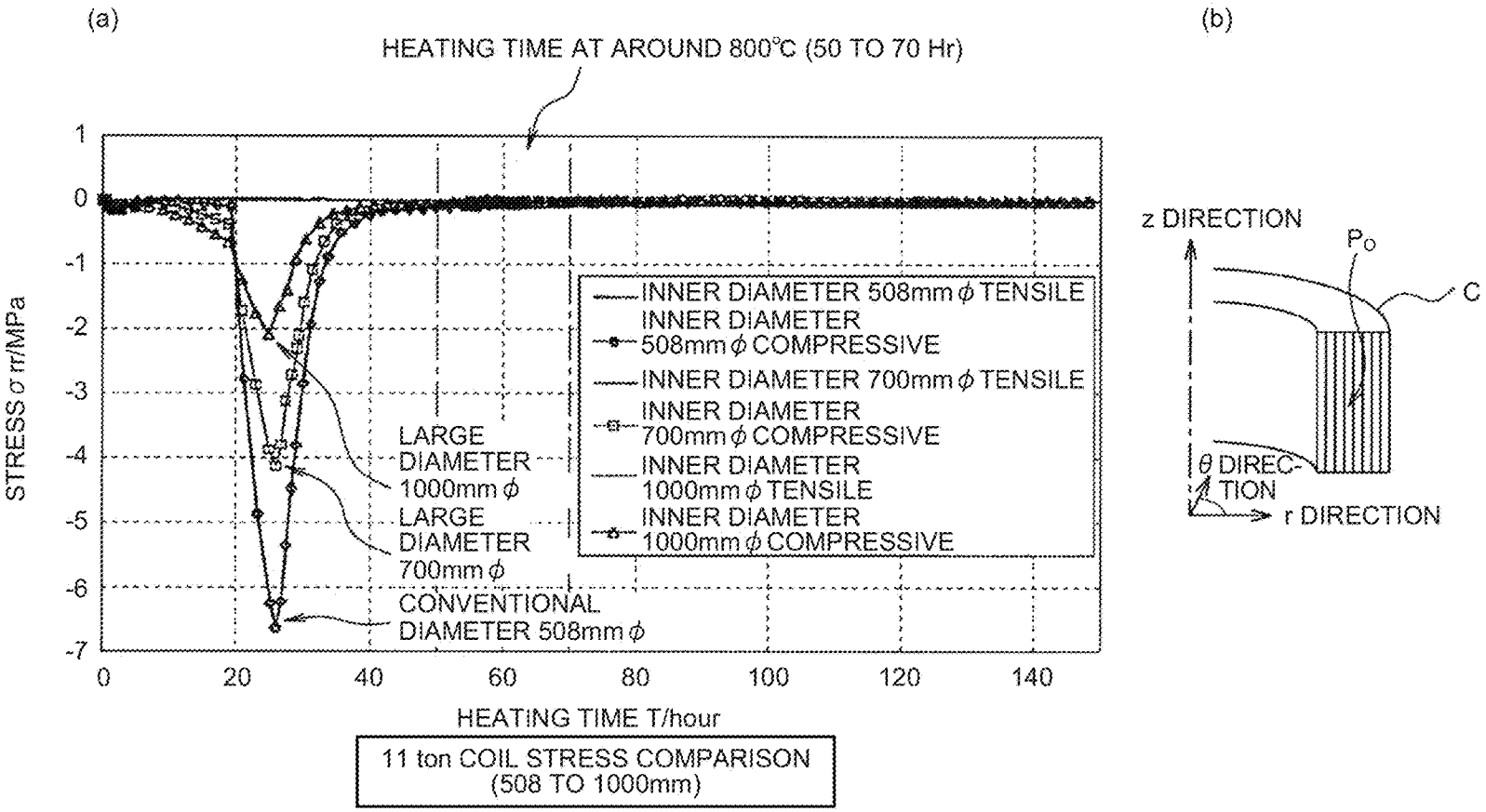
FIG. 12 (*a*) is a graph illustrating changes over time in stress occurring in a coil, whereas FIG. 12 (*b*) is a drawing illustrating corresponding directions of the coil in (a).
Figure 13:
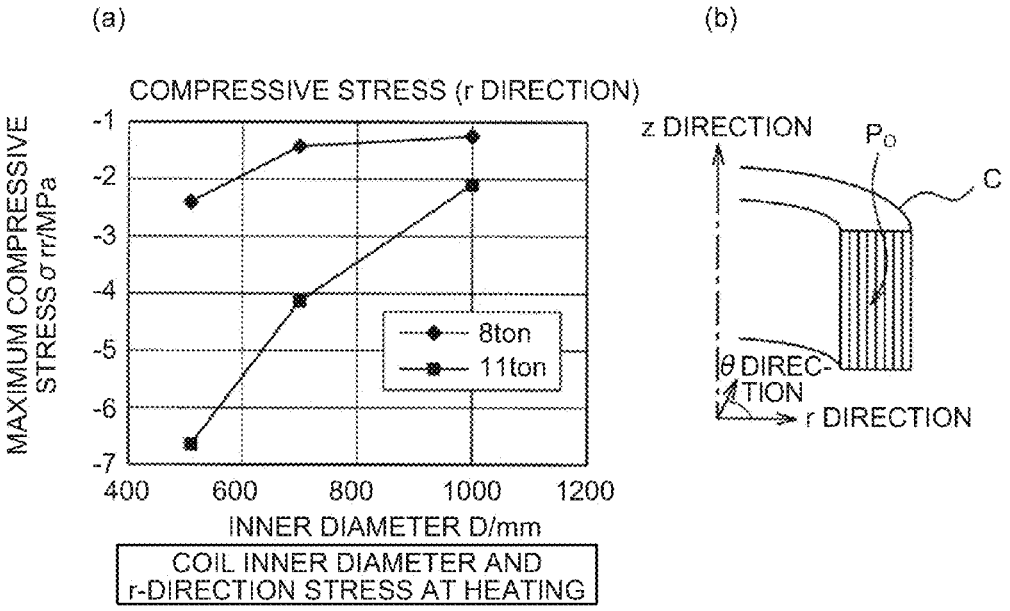
FIG. 13 is a graph illustrating the maximum stresses (absolute values) occurring in a coil during annealing for comparison, and (b) is a drawing illustrating corresponding directions of the coil in (a).

As representative examples of results when performed stress calculation based on the results of the heat transfer calculation described above, stresses in the coil radial direction are illustrated in FIG. 12, and the maximum radial stresses for different inner diameters are illustrated in FIG. 13. The symbol $P_0$ in FIG. 12 (*b*) and FIG. 13 (*b*) indicates the center of a coil section. As is evident from FIG. 12 and FIG. 13, it has been found that the stress occurring inside the coil decreases as the coil inner diameter increases. In addition, it has been found that because an inner diameter of 508 mm gives a stress of nearly 10 MPa, a small fluctuation in annealing conditions may lead to characteristics deterioration. In view of this, a stress causing no characteristics deterioration was set to 6 MPa or less to be on the safe side.

From the results mentioned above, a comparison was performed between a batch annealing time when the batch annealing furnace according to one aspect of the present invention was used and a batch annealing time in the conventional batch annealing furnace illustrated in FIG. 16 (FIG. 19). Other cases were also studied for reference.

As described above, when performing heating and cooling of a coil with thermal radiation in the conventional batch annealing furnace for coils illustrated in FIG. 16 (FIG. 19), the temperature distribution inside the coil deviates to produce an internal stress. In order to resolve it, with respect to FIG. 1 (the cooling pipe 10 whose bottom has the convex semispherical shape) as the first embodiment according to the present invention, FIG. 2 (the cooling pipe 10 whose bottom is the flat plate) as the second embodiment according to the present invention, FIG. 3 (the bottom is the convex semispherical shape and the diameter expands toward the upper part) as the third embodiment according to the present invention, and FIG. 16 as the conventional batch annealing furnace having no cooling pipe for comparison, annealing times were compared and studied by a method shown below.

With respect to (1) annealing using the first embodiment according to the present invention (FIG. 1), (2) annealing using the second embodiment according to the present invention (FIG. 2), (3) annealing using the third embodiment according to the present invention (FIG. 3), and (4) annealing using the conventional batch annealing furnace illustrated in FIG. 16, Table 1 lists a comparison of the annealing times when performing annealing calculation so as to be 6 MPa or less that produces no stress. The annealing time is indicated with a relative ratio with the annealing time of annealing using the conventional batch furnace (FIG. 16) being 1. Accordingly, a smaller value shows a shorter annealing time, thus improving production efficiency.

TABLE 1

| | (1) (FIG. 1) First embodiment | (2) (FIG. 2) Second embodiment | (3) (FIG. 3) Third embodiment | (4) (FIG. 16) Conventional example |
|---|---|---|---|---|
| Produced stress | 1 MPa or less | 1 MPa or less | 1 MPa or less | 2 MPa or less |
| Annealing time | 0.6 | 0.8 | 0.5 | 1 |

From the comparison result of the annealing time listed in Table 1, it has been confirmed that the example of the present invention reduces the annealing time as compared with the conventional example by using the cooling pipe and controls the stress to be 6 MPa or less, thereby manufacturing high-quality coils with high productivity.

Figure 14:
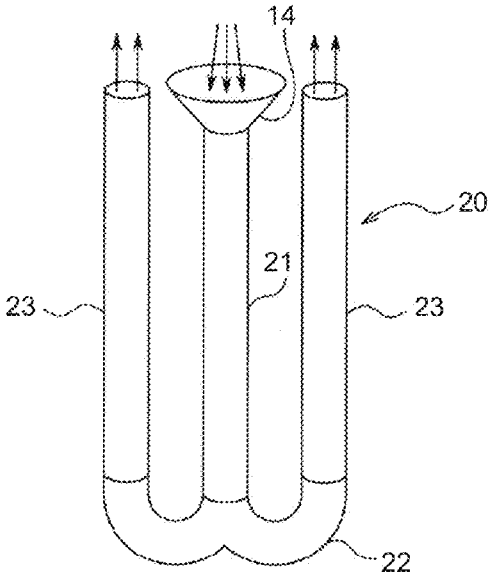
FIG. 14 is a drawing illustrating a modification to a cooling pipe of the batch annealing furnace for coils according to one aspect of the present invention (a first modification).
Figure 15:
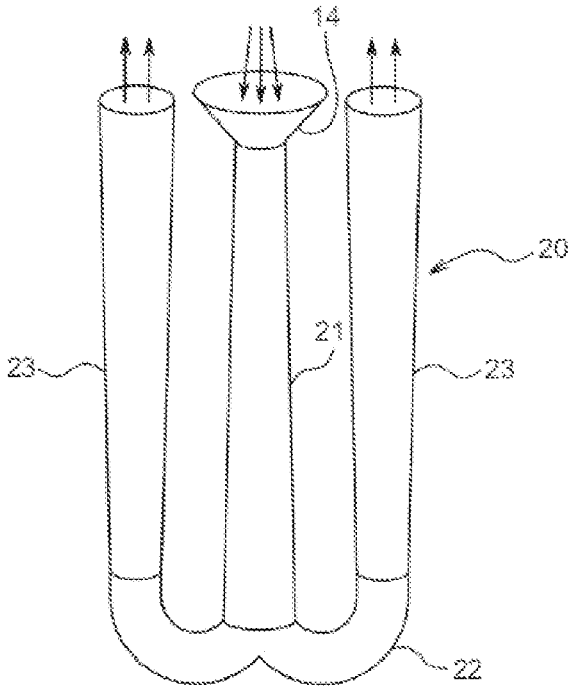
FIG. 15 is a drawing illustrating a modification to a cooling pipe of the batch annealing furnace for coils according to one aspect of the present invention (a second modification).

The shape of the cooling pipe according to the present invention is not limited to the cooling pipe 10 of a double pipe type illustrated in FIG. 1 to FIG. 3. For example, as illustrated in FIG. 14 and FIG. 15, a cooling pipe of an individual pipe type may be configured by combining several pipes. In other words, this cooling pipe 20 includes an introduction pipeline 21 that introduces the coolant from the upper part of the inner cover toward the coil support base, a curved pipeline 22 that changes the direction of the flow of the coolant introduced into the introduction pipeline 21 so as to be directed toward the upper part of the inner cover 7 (not illustrated in the drawing), and a return pipeline 23 that returns the coolant whose direction has been changed by the curved pipeline 22 toward the upper part of the inner cover 7.

When adopting this constitution, it is important to connect the curved pipeline 22 as a turning point to the introduction pipeline 21 and the return pipeline 23 smoothly. As illustrated in FIG. 15, it is preferable that the diameter of at least either one of (both in the drawing) the introduction pipeline 21 and the return pipeline 23 is expanded toward an outlet of the coolant (toward the downstream side).

REFERENCE SIGNS LIST

1 Batch annealing furnace
2 Coil support base
3 Cushion
4 Spacer
5 Burner
6 Heater
7 Inner cover
8 Furnace wall
9 Furnace bottom
10 Cooling pipe (of a double pipe type)
11 Inner pipe
12 Outer pipe
13 Bottom plate
20 Cooling pipe (of an individual pipe type)
21 Introduction pipeline
22 Curved pipeline
23 Return pipeline
110 Heat insulating material
C Coil

The invention claimed is:

1. A batch annealing furnace for coils configured to anneal a coil in which a steel sheet is wound, the batch annealing furnace comprising:

a coil support base on which an end face of the coil is mounted and that supports the coil with an axis of the coil being upright;

an inner cover that covers an entire body of the coil mounted on the coil support base; and a cooling pipe that extends downward from an upper part of the inner cover to a cavity of an inner peripheral part of the coil mounted on the coil support base and cools the coil from an inner surface side by passing a coolant through inside of the cooling pipe, wherein the cooling pipe comprises a double pipe comprising a cylindrical inner pipe and a cylindrical outer pipe that surrounds the inner pipe, the inner pipe serves as an introduction pipeline that introduces the coolant from the upper part of the inner cover toward the coil support base, and an area between the outer pipe and the inner pipe serves as a return pipeline that returns the coolant from the coil support base toward the upper part of the inner cover, and wherein at a location where a direction of flow of the coolant passing through the introduction pipeline and the return pipeline changes, a bottom plate having a semispherical shape convex downward whose diameter is half the radius of the outer pipe or more reverses the direction.

2. The batch annealing furnace for coils according to claim 1, wherein at least one of the introduction pipeline and the return pipeline has a diameter expanded toward downstream.

3. A batch annealing furnace for coils configured to anneal a coil in which a steel sheet is wound, the batch annealing furnace comprising:

a coil support base on which an end face of the coil is mounted and that supports the coil with an axis of the coil being upright;

an inner cover that covers an entire body of the coil mounted on the coil support base;

at least one burner located outside of the inner cover and a heater below the coil support base for heating the coil; and a cooling pipe that extends downward from an upper part of the inner cover to a cavity of an inner peripheral part of the coil mounted on the coil support base and cools the coil from an inner surface side by passing a coolant through inside of the cooling pipe to enable cooling of the coil from the inner surface during heating, wherein:

the cooling pipe comprises:

an introduction pipeline that introduces the coolant from the upper part of the inner cover toward the coil support base;

a curved pipeline that changes a direction of flow of the coolant introduced into the introduction pipeline toward the upper part of the inner cover, the curved pipeline having a U-shape, a cross section of a bottom of the U-shape being semicircular; and a return pipeline that returns the coolant of which direction of flow has changed by the curved pipeline toward the upper part of the inner cover.

4. The batch annealing furnace for coils according to claim 3, wherein the return pipeline comprises two or more return pipelines, the curved pipeline comprises two or more corresponding curved pipelines, and each return pipeline is connected to the introduction pipeline via a corresponding curved pipeline.

5. The batch annealing furnace for coils according to claim 3, wherein at least one of the introduction pipeline and the return pipeline has a diameter expanded toward downstream.

6. The batch annealing furnace for coils according to claim 4, wherein at least one of the introduction pipeline and the return pipeline has a diameter expanded toward downstream.

7. The batch annealing furnace for coils according to claim 3, wherein both the introduction pipeline and the return pipeline have a diameter expanded toward downstream.

8. The batch annealing furnace for coils according to claim 3, wherein an opening is at an end of the introduction pipeline, and the opening has a funnel shape whose diameter expands towards the upper part of the inner cover.

9. The batch annealing furnace for coils according to claim 3, wherein the cooling pipe contains a gas as coolant.

10. The batch annealing furnace for coils according to claim 3, wherein the gas is air, nitrogen, argon, helium, a gas mixture of inert gas and air in which an oxidative gas is reduced, or a reducing gas.

* * * * *